US006115892A

United States Patent [19]

Malin et al.

[11] Patent Number: 6,115,892

[45] Date of Patent: Sep. 12, 2000

[54] TRANSVERSE DIRECTION ZIPPER TAPE

[75] Inventors: Art Malin, Northbrook; Lawrence Share, Skokie; Donald L. Van Erden, Wildwood, all of Ill.

[73] Assignee: Illinois Tool Works Inc., Glenview, Ill.

[21] Appl. No.: 09/356,304

[22] Filed: Jul. 16, 1999

Related U.S. Application Data

[62] Division of application No. 09/082,711, May 21, 1998, abandoned.

[51] Int. Cl.[7] ..... A44B 19/00; B65D 33/00

[52] U.S. Cl. ..... 24/587; 24/399; 24/400; 24/410

[58] Field of Search ..... 24/399, 400, 587, 24/576

[56] References Cited

U.S. PATENT DOCUMENTS

| | | | |
|---|---|---|---|
| 2,756,172 | 7/1956 | Kidd | 24/399 |
| 4,909,017 | 3/1990 | McMahon et al. | 53/410 |
| 5,004,356 | 4/1991 | Matsui | 24/587 |
| 5,023,122 | 6/1991 | Boeckmann et al. | 24/587 |
| 5,185,909 | 2/1993 | Inagaki | 24/587 |
| 5,198,055 | 3/1993 | Wirth et al. | 24/587 |
| 5,655,273 | 8/1997 | Tomic et al. | 24/587 |
| 5,672,009 | 9/1997 | Malin | 24/587 |

FOREIGN PATENT DOCUMENTS

| | | | |
|---|---|---|---|
| 0566363 | 10/1993 | European Pat. Off. | 24/399 |
| 1546138 | 11/1968 | France | 24/400 |

*Primary Examiner*—Victor N. Sakran
*Attorney, Agent, or Firm*—Pitney, Hardin, Kipp & Szuch LLP

[57] ABSTRACT

A zipper strip for a reclosable package having a transverse zipper is provided. The zipper strip comprises a male interlocking profile and a female interlocking profile. Each profile includes an interlocking member and an integral web which defines a leading flange. The leading flanges are sealed to thermoplastic film material which is used to make the reclosable packages and to each other. One of leading flanges is provided with a perforation along its length so that it can be separated by pulling the profiles apart.

4 Claims, 6 Drawing Sheets

TRANSVERSE DIRECTION ZIPPER TAPE

This application is a divisional of application Ser. No. 09/082,711; filed May 21, 1998; now abandoned.

BACKGROUND OF THE INVENTION

1. Field of the Invention

The present invention relates to reclosable plastic bags and packages of the type in which food products, such as chips and cereal, and other goods are packaged for sale to consumers. More particularly, the present invention relates to a reclosable zipper strip for use in transverse-zippered reclosable plastic bags made on form-fill-seal (FFS) machines.

2. Description of the Prior Art

The present invention relates to improvements in the package-making art and may be practiced in the manufacture of thermoplastic bags and packages of the kind that may be used for various consumer products, but which are particularly useful for food products which must be kept in moisture and air-tight packages, free from leakage until initially opened for access to the product contents, which packages are then reclosable by zipper means to protect any remainder of the product therein.

The prior art is fairly well-developed, but nevertheless remains susceptible to improvement contributing to increased efficiency and cost effectiveness.

In particular the present invention relates to the area of reclosable packaging known as the transverse zipper. When making a bag with a transverse zipper, the zipper is attached transverse to the longitudinal axis of the material used to make the bag, as opposed to being attached to the material parallel to the longitudinal axis. A method and apparatus for making reclosable plastic bags with a transverse zipper on a FFS machine is disclosed in U.S. Pat. No. 4,909,017.

Prior to the introduction of the transverse zipper to the reclosable packaging field, reclosable plastic bags made on FFS machines were typically made with a longitudinal zipper, i.e. a zipper parallel to the longitudinal axis of the thermoplastic film used to make the bags. However, there are two primary problems with the longitudinal zipper. First, there is a problem in attaining satisfactory sealing of the bags against leakage since the transverse, or side, sealing bars of the FFS machine must flatten and seal the zipper at the same time they are sealing the thermoplastic film from which the packages are being made. The difficulty with which this sealing is consistently and successfully achieved is reflected by the high occurrence of leaking packages.

Second, the length of reclosable bags made on FFS machines when the zipper is attached parallel to the longitudinal axis of the thermoplastic film is limited to the diameter of the filling tube of the FFS machine. Thus, generally bags of this type are wider than they are long. While such bags are suitable for certain products where shorter bags are desirable, such as cheese and chicken parts, these bags are not suitable for applications in which longer bags are desirable, for example chips and other snack foods.

Among the approaches taken to solve these problems has been the substitution of a transverse zipper for the longitudinal zipper. When a transverse zipper is provided, the transverse sealing bars associated with the FFS machine do not flatten the zipper during formation of the top and bottom seals of the package since the transverse sealing bars may seal the zipper to the thermoplastic sheet material transversely thereacross without contacting the zipper. In addition, when a transverse zipper is used the length of the packages made on the FFS machine can be varied and is not limited to the diameter of the filling tube.

The present invention relates to a particular type of zipper strip which may be used in transverse zipper applications, a method for attaching the zipper strip to the thermoplastic film, and a method for making reclosable bags using the zipper-equipped thermoplastic film.

A typical zipper strip used in transverse zipper applications has interlocked male profile and female profiles. Each profile has an interlocking member and a laterally extending web defining a leading flange and a trailing flange on either side of the interlocking member. The zipper strip is initially secured to the thermoplastic film by sealing the leading flange of one of the profiles thereto. This allows the film to carry the zipper strip into the FFS machine where the bag is formed and the final seals are made. The problem with this approach, however, is that the leading flange which is not secured to the film has a tendency to flare out as the film enters the FFS machine and folds around the filling tube. The result of this flaring is that the unsecured leading flange has a tendency either to jam the FFS machine or to become caught on the machine and thereby cause the profiles to separate. While the zipper strip can be made without the second leading flange and thereby avoid this problem, the absence of this second leading flange and its subsequent attachment to the film can result in poor zipper opening mechanics and a weak seal between the zipper strip and the bag when the bag is opened for the first time by pinching the front and rear panels of the bag and pulling them apart (the current practice for opening snack packages). A four-flange seal, that is the male and female leading and trailing flanges being sealed to the bag walls, is the best and most secure method of attaching the zipper.

It is therefore an object of the present invention to provide a zipper strip for use in transverse-zippered reclosable plastic bags having two leading flanges which overcomes the aforementioned flaring problem. Another object of the present invention is to provide a method for attaching the zipper strip to the thermoplastic film such that there is no danger of jamming the FFS machine or separating the zipper as the transverse zipper-equipped film enters the FFS machine. Yet another object of the present invention is to provide a method of making reclosable bags using the transverse zipper-equipped film. Yet another object of the present invention is to provide a bag which utilizes the zipper strip.

SUMMARY OF THE INVENTION

Accordingly, the present invention is, in four aspects, a zipper strip for use with transverse zippered bags, a method for attaching the zipper strip to a continuous supply of thermoplastic film, a method for making reclosable bags on a FFS machine using the transverse zipper-equipped film, and a reclosable bag comprising the zipper strip.

In accordance with the first aspect of the present invention, the zipper strip includes a male profile and a female profile for mating with the male profile. The male profile includes a male interlocking member and a laterally extending web defining a leading flange. Likewise, the female profile includes a female interlocking member and a laterally extending web defining a leading flange. The male interlocking member is engageable within the female interlocking member to join the male and female interlocking profiles together.

One of the leading flanges is provided with a weak perforation along its length so that it can be separated by pulling the profiles apart. This will allow the user to separate the profiles when first opening the finished bag, as discussed below.

In the second aspect of the present invention, thermoplastic film is intermittently paid off a continuous supply of the same and fed into a FFS machine. A length of the interlocked zipper strip is attached to the flat film transverse to its longitudinal axis each time it is brought to rest as it advances in bag-length increments. The strip is applied to the film with one of the profiles on top of the other profile with the leading flanges directed in the direction of motion of the film and is attached to the film by sealing the male and female leading flanges to each other and to the film on the side of the perforation opposite to the interlocking members. With both leading flanges secured to the film and to each other there is no danger of the FFS machine jamming or of the profiles becoming separated when the film enters the FFS machine. The zipper-equipped film may be rolled up and used on a FFS machine at a later time, or may be fed directly into a FFS machine to make reclosable bags.

In the third aspect of the present invention the thermoplastic film with the transverse zipper strips attached at bag length intervals is fed into the FFS machine where it is formed into a bag, filled, and sealed. Specifically, the transverse zipper-equipped thermoplastic film is folded over the collar of the FFS machine and wrapped around the filling tube to form a tube. The longitudinal edges are then sealed to form a back seam. The transverse sealing jaws then seal the bottom of the tube to form an open bag. The bag is then filled, if desired. Finally, the transverse sealing jaws seal the portions of the leading flanges between the perforation and the interlocking members to the bag without sealing them to each other and seal the top of the bag so as to make a completed bag.

In accordance with the fourth aspect of the present invention, the finished bag is opened by pulling outwardly on the bag walls, which pulling results in the breaking of the perforation, thereby separating the profiles, disengagement of the interlocking members, and opening of the top seal, thus giving the consumer access to the interior of the bag.

The present invention will now be described in more complete detail with frequent reference being made to the figures identified below.

DETAILED DESCRIPTION OF THE PREFERRED EMBODIMENTS

Figure 1:
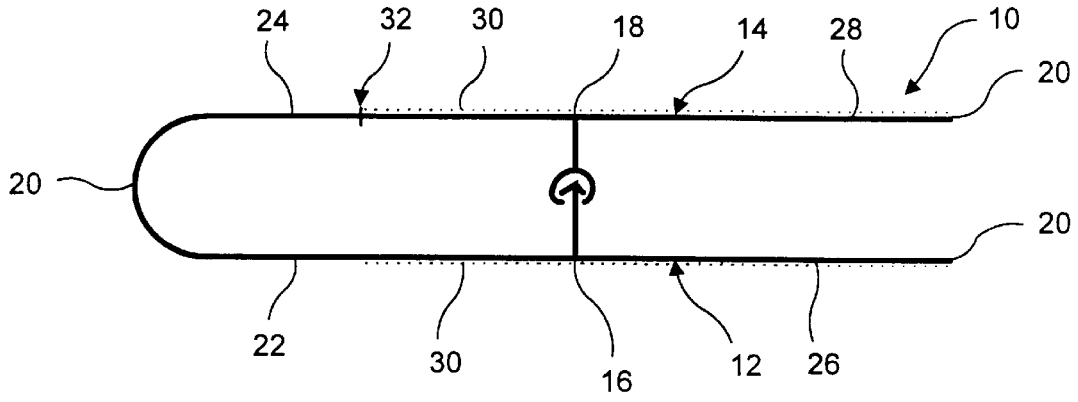
FIG. 1 is a cross-sectional view of a zipper strip in accordance with the one embodiment of the invention.

Referring specifically to the figures identified above, FIG. 1 is a cross-sectional view of a zipper strip 10 in accordance with the first aspect of the present invention.

The zipper strip 10 comprises a male profile 12 and a female profile 14. The profiles 12, 14 are made of a plastic commonly used in the packaging industry, such as polyethylene. The male profile 12 has a male interlocking member 16 which may have an arrow-shaped cross-section, or as shown in FIG. 1, an asymmetrical arrow-shaped cross section designed to make the zipper strip 10 easier to open from one side or the other. The female profile 14 includes a female interlocking member 18 comprising two inwardly curving members forming a receptacle or channel into which male interlocking member 16 may be engaged. It should be noted that while these configurations for male and female members 16, 18 are preferred, any configuration which provides for interlocking may be used.

The male and female profiles 12, 14 include male and female leading flanges 22, 24 and male and female trailing flanges 26, 28 which are defined by a folded U-shaped web 20 which may be coextruded with male and female interlocking members 16, 18 or extruded separately and attached at a later time.

The leading flanges 22, 24 are so called because these flanges first enter the FFS machine after the zipper strip 10 is attached to the thermoplastic film. Ultimately, the leading flanges 22, 24 will reside inward of the mouth of the plastic bag or package manufactured on the FFS machine. The web 20 may be equipped with a heat activated adhesive 30 to aid in the sealing of the zipper strip 10 to the film.

Figure 2:
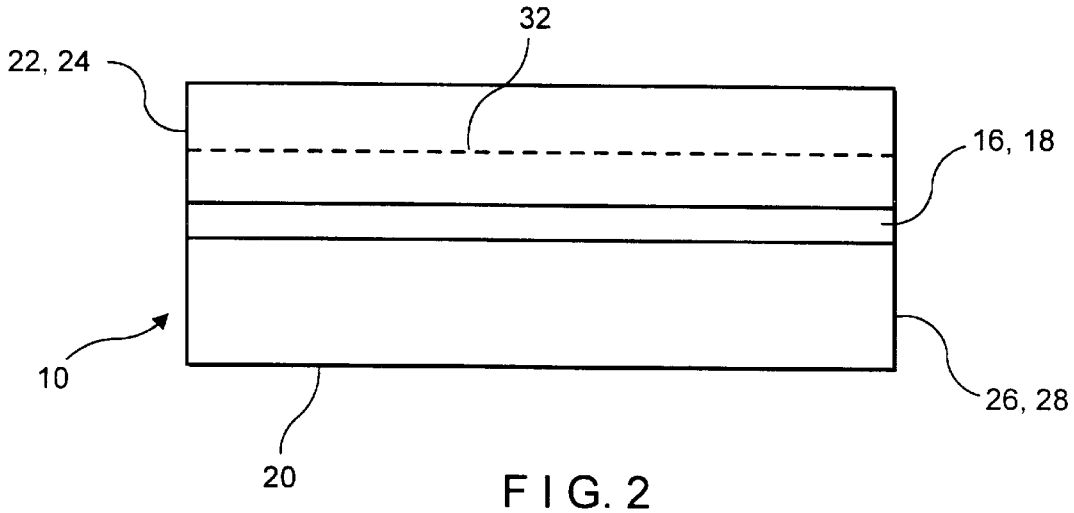
FIG. 2 is a plan view of a length of the zipper strip.

FIG. 2 is a plan view of a length of the zipper strip 10. As is clear from FIGS. 1 and 2, the female leading flange 24 is provided with a weak perforation 32 across its length so that the female leading flange 24 may be separated by pulling the profiles 12, 14 apart. As discussed below, the perforation 32 allows the consumer to gain access to the contents of the bag upon first opening the same.

Figure 3:
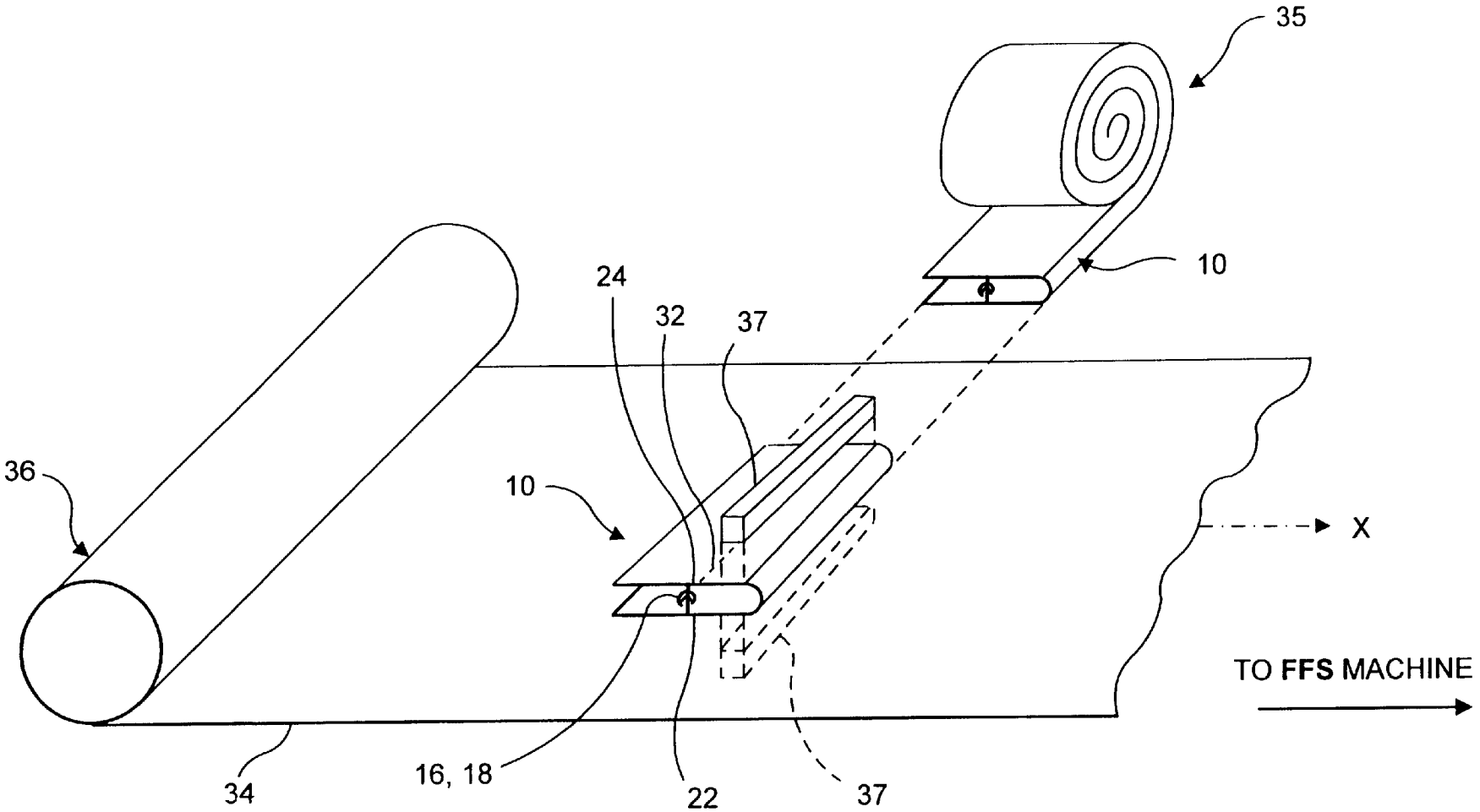
FIG. 3 is a perspective view of the zipper strip being attached to thermoplastic film.

FIG. 3 depicts how a zipper strip 10 is attached to the thermoplastic film 34 having a longitudinal axis X in accordance with the present invention. The zipper strip 10 is supplied from a continuous roll 35 and is pulled or pushed across the film 34 and disposed thereon by a positioning device 72 (not shown in FIG. 3 for clarity). The positioning device 72 can take any of a variety of forms well known to those skilled in the reclosable packaging art, such as a vacuum conveyor for pulling the zipper strip 10 across the film 34 and a knife for cutting the zipper strip 10 from the continuous roll thereof 35.

The thermoplastic film 34 is paid off from a continuous roll 36, as shown in FIG. 3, in increments equal to the length of the bags which will ultimately be formed from the film 34. The longitudinal axis of the film 34 is parallel to the direction of travel of the film 34. Each time the film 34 comes to rest, the zipper strip 10 is disposed on the film 34 transverse to the longitudinal axis X with one of the profiles on top of the other profile and the leading flanges 22, 24 projecting in the direction of motion of the film 34. The orientation of the profiles depends on which side of the zipper, if any, is adapted to be the opening side. As disclosed in U.S. Pat. No. 4,909,017, the zipper strip 10 has a length approximately equal to half the width of the film 34 and is disposed centrally thereon. Heater seal bars 37 are positioned to seal the portions of the leading flanges 22, 24 on the side of the perforation 32 opposite to the interlocking members 16, 18 to the film 34 and to each other.

Figure 4:
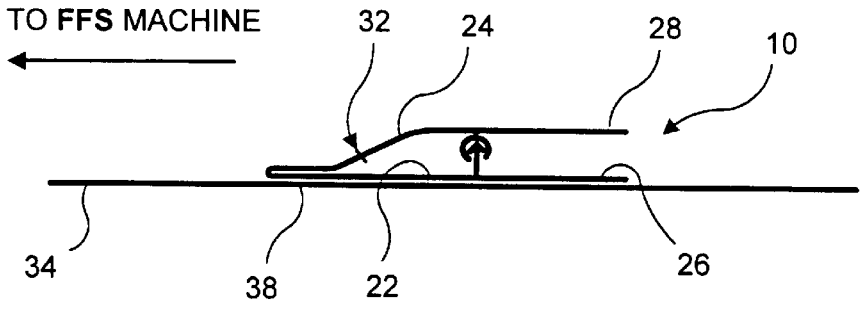
FIG. 4 is a cross-sectional view of the zipper strip and the thermoplastic film after the leading flanges of the zipper strip have been attached thereto.

FIG. 4 shows a cross section of the zipper strip 10 and the film 34 after the zipper strip 10 has been sealed thereto. The portions of the leading flanges 22, 24 to the left of the perforation are sealed to each other and to the film at 38. Seal 38 may be a spot seal or a full seal across the length of the flanges. The film 34 is thus able to carry the strip 10 into the FFS machine, and the perforation 32 is strong enough such that there is no danger of the perforation 32 breaking and causing female leading flange 24 to flare out and jam the FFS machine or to otherwise get caught in the machine and pull the zipper strip 10 apart. The transverse zipper-equipped material may either be re-rolled for later use on a FFS machine, or may be fed directly into a FFS machine to make reclosable bags.

Figure 5:
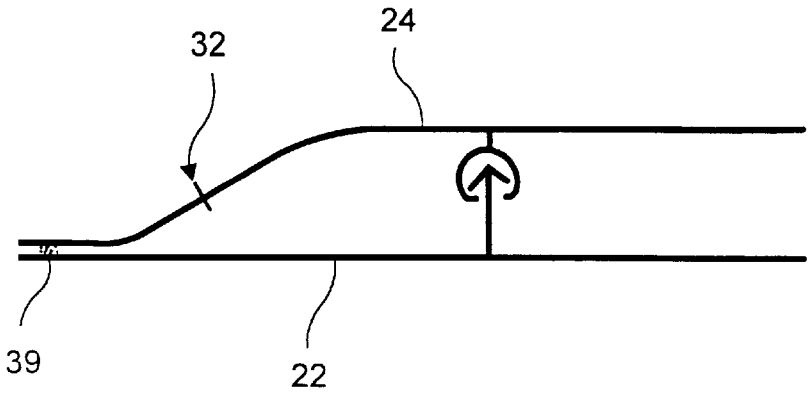
FIG. 5 is a cross-sectional view of an alternate zipper strip which may be used to practice the present invention.
Figure 6:
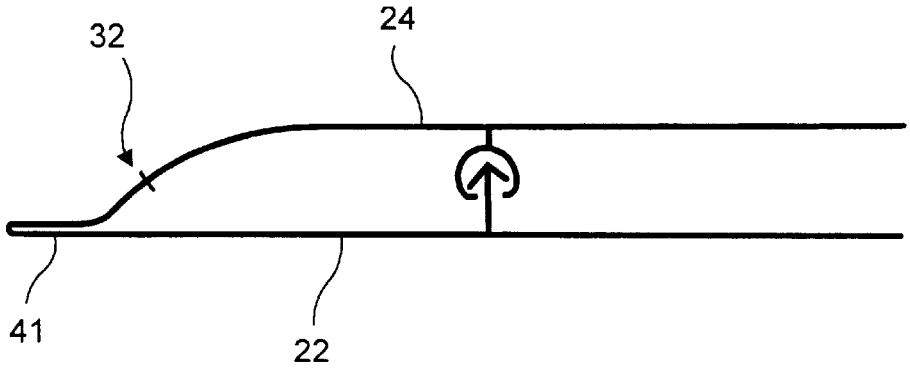
FIG. 6 is a cross-sectional view of an alternate zipper strip which may be used to practice the present invention.
Figure 7:
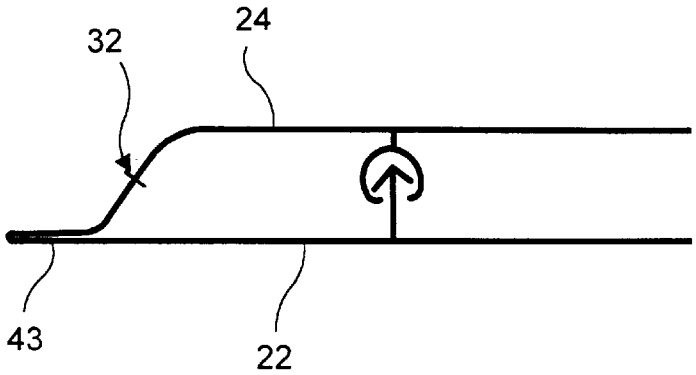
FIG. 7 is a cross-sectional view of an alternate zipper strip which may be used to practice the present invention.

Alternate embodiments of the zipper strip 10 may be used to practice the present invention. FIGS. 5, 6 and 7 show examples of these alternate embodiments. In FIG. 5, the leading flanges 22, 24 are initially separated and are attached to each other at 39, such as by heat sealing or through the use of an adhesive, either in the factory, ahead of the FFS machine, or at the FFS machine. This zipper strip may then be attached to the thermoplastic film in the same manner as the strip of FIG. 1. Alternatively, this zipper strip may be disposed on the thermoplastic film with the leading flanges detached, the sealing bars sealing the leading flanges to each other for the first time. In FIG. 6, the web 20 is U-shaped as in the embodiment of FIG. 1. However, the leading flanges 24, 26 are presealed to each other at 41, which presealed area is sealed to the thermoplastic film. In FIG. 7, the web is extruded with a nose 43 which joins the leading flanges 22, 24 and which is sealed to the thermoplastic film.

Figure 8:
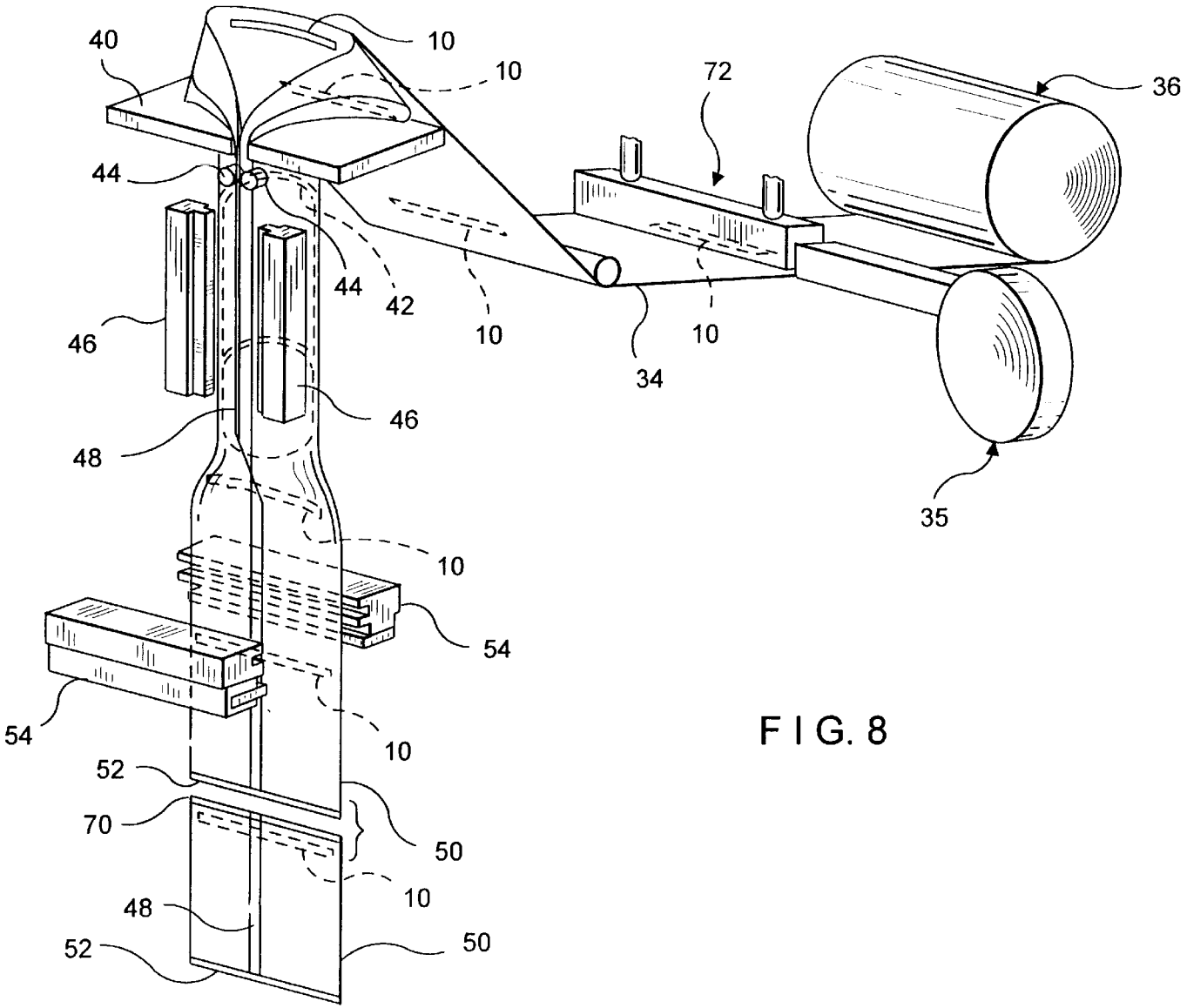
FIG. 8 is a perspective view of an FFS machine used to make transverse-zippered reclosable plastic bags.

In the third aspect of the present invention, the transverse zipper-equipped film is fed into an FFS machine, as shown in FIG. 8. The thermoplastic film 34 is fed downwardly over collar 40 and folded around filling tube 42. The edges of the film are brought together and pressed together by a pair of rollers 44. The edges are then welded together by heater bars 46 to form a longitudinal back seam 48. Contents may then dropped through the tube 42 into the bag 50 which has a lower seam 52. As discussed below, the lower seam 52 was made when the preceding bag was completed.

Figure 9:
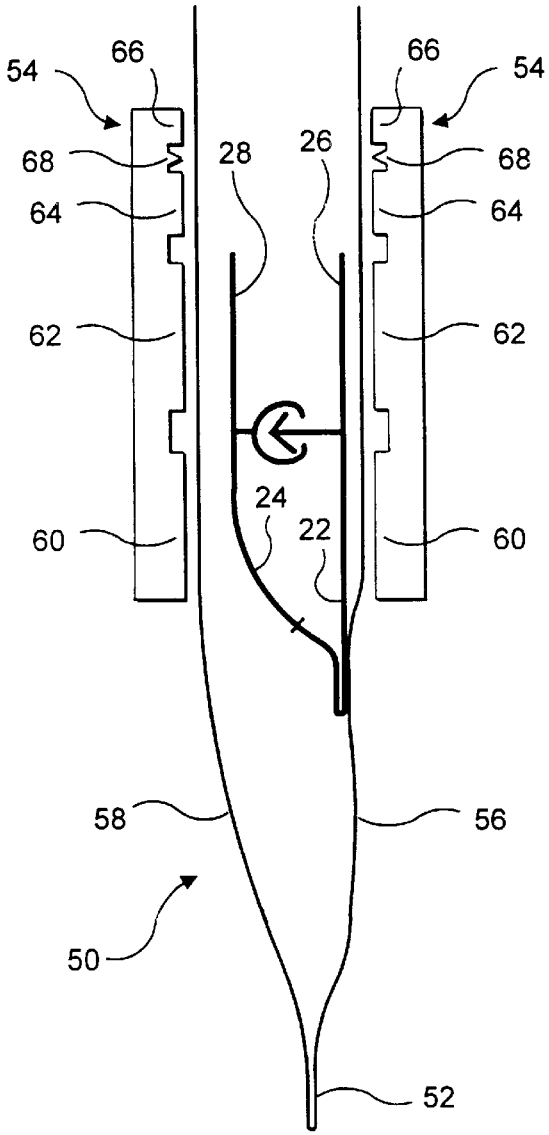
FIG. 9 is a cross-sectional view of the FFS machine cross seal jaws disposed to complete the top of a bag and the bottom of a succeeding bag.

After introduction of the contents, the top of the bag is completed by the action of cross seal jaws 54, which perform five simultaneous functions. First, as shown in FIG. 9 which is a cross sectional view of bag 50 and cross seal jaws 54, cross seal jaw portions 60 seal the portions of the leading flanges 22, 24 between the perforation and the interlocking members to the front and back walls 56, 58 of the bag without sealing them to each other. Second, cross seal jaw portions 62 seal the trailing flanges 26, 28 of the zipper strip 10 to the front and back walls 56, 58 without sealing the trailing flanges 26, 28 to each other. The use of the heat activated adhesive 30 makes it possible to seal the flanges to the bag walls 56, 58 without sealing the flanges to each other. Third, cross seal jaw portions 64 seal the top of the bag to form a pilfer evident seal 70. Fourth, cross seal jaw portions 66 make the lower seam 52 for the next succeeding bag. And fifth, knife portions 68 cut the completed bag 50 from the film 34. The completed bag 50 has a pilfer evident seal 70, a transverse zipper 10, a lower seam 54 and a back seam 48.

Figure 10:
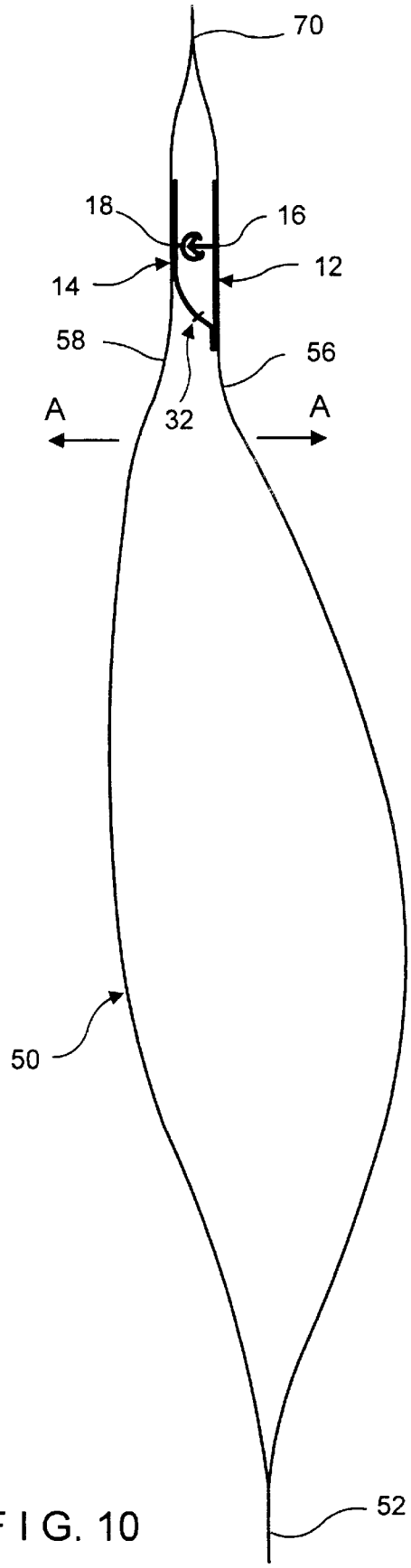
FIG. 10 is a cross-sectional view of a sealed completed bag.

In accordance with the fourth aspect of the present invention, a cross section of the completed bag 50 is shown in FIG. 10. Connected male and female profiles 12, 14 are each sealed to the opposite bag walls 56, 58. This four-flange seal, as discussed above, eliminates any zipper pealing problems and opening mechanics problems.

A consumer desiring to gain access to the contents of the bag need only pull outwardly on the bag walls 56, 58 as shown by arrows A. This pulling action will first cause perforation 32 to break, thereby separating the profiles 12, 14. Next, the interlocking members 16, 18 will separate. And third, the pilfer evident seal 70 will open. The consumer thus has access to the interior of the bag as shown in FIG. 11, which bag may be reclosed by the interlocking of the profiles 12, 14.

Figure 11:
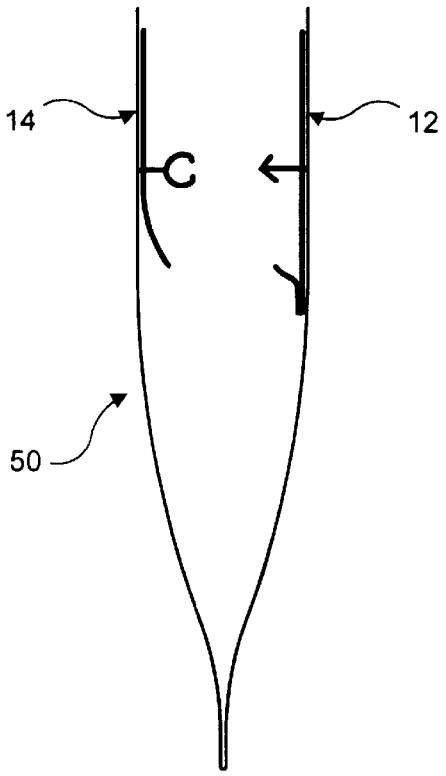
FIG. 11 is a cross-sectional view of an open completed bag.
Figure 12:
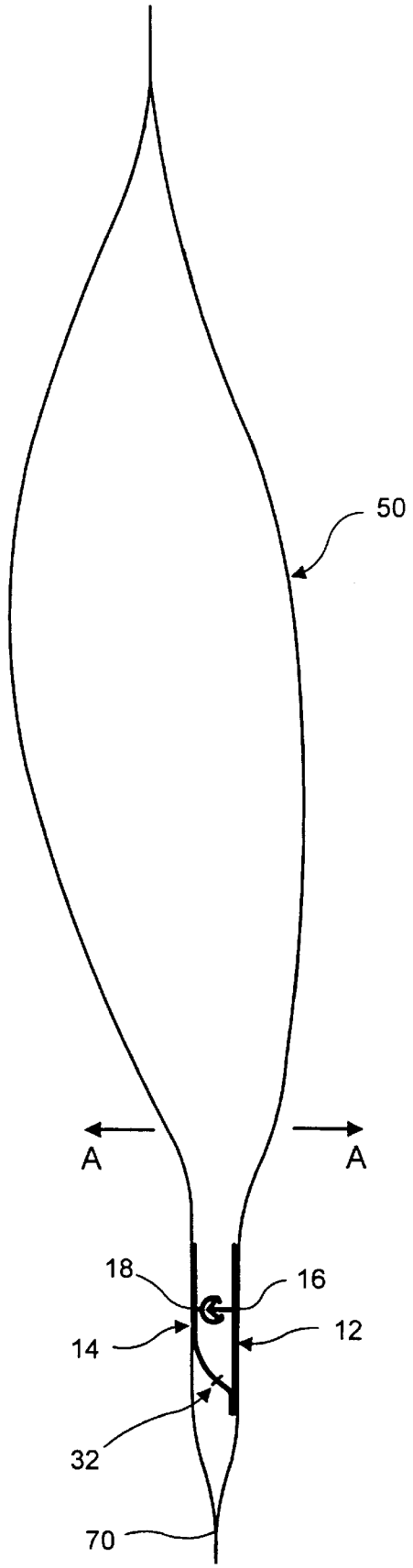
FIG. 12 is a cross-sectional of an alternate sealed completed bag in accordance with the present invention.

In an alternate embodiment the zipper strip can be provided at the bottom of the bag 50, as shown in FIG. 11. It would be a simple matter to one skilled in the art to modify the operation of the FFS machine, as discussed above, to produce such bags. A consumer would, of course, re-orient the bag during use so that the zipper strip is at the top. However, the vertical orientation of the zipper strip is reversed, resulting in different opening mechanics. When the bag of FIG. 11 is initially opened, first the interlocking members 16, 18 separate, then the perforation 32 breaks, and finally the pilfer evident seal 70 opens.

Modifications to the above would be obvious to those of ordinary skill in the art, but would not bring the invention so modified beyond the scope of the appended claims.

We claim:

1. A zipper strip for a reclosable package having first and second opposing walls, said zipper strip comprising:

a male interlocking profile, said male interlocking profile including a male interlocking member and an integral web defining a male leading flange;

a female interlocking profile, said female interlocking profile including a female interlocking member and an integral web defining a female leading flange, said male interlocking member being engageable within said female interlocking member to join said male and female interlocking profiles together;

wherein one of said leading flanges is provided with a perforation along its length, a first seal area on said one of said leading flanges on the side of said perforation opposite to said interlocking members, a second seal area on said one of said leading flanges on the same side of said perforation as said interlocking members, a third seal area on the other leading flange opposite to said first seal area, and a fourth seal area on the other leading flange opposite to said second seal area;

wherein the leading flange having said perforation is sealable to the other leading flange at said first and third seal areas;

wherein the other leading flange is sealable to said first package wall at said third seal area;

wherein the leading flange having said perforation is sealable to said second package wall at said second seal area; and wherein the other leading flange is sealable to said first package wall at said fourth seal area.

2. A zipper strip according to claim 1:

wherein said male web further defines a male trailing flange; and wherein said female web further defines a female trailing flange;

said trailing flanges being sealable to opposing package walls.

3. A zipper strip according to claim 1 wherein said leading flanges are presealed to each other at said first seal area.

4. A zipper strip for a reclosable package having first and second opposing walls, said zipper strip comprising:

a male interlocking profile, said male interlocking profile including a male interlocking member and an integral web defining a male leading flange;

a female interlocking profile, said female interlocking profile including a female interlocking member and an integral web defining a female leading flange, said male interlocking member being engageable within said female interlocking member to join said male and female interlocking profiles together;

and a nose portion joining said leading flanges;

wherein one of said leading flanges is provided with a perforation along its length with said nose portion located on the side of said perforation opposite to said interlocking members, said perforation defining a first seal area on said one of said leading flanges on the same side of said perforation as said interlocking members and a second seal area on the other leading flange opposite to said first seal area;

wherein said nose portion is sealable to one of said package walls;

wherein the leading flange having said perforation is sealable to the other package wall at said first seal area; and wherein the other leading flange is sealable to the same package wall as said nose portion at said second seal area.

* * * * *